United States Patent [19]

Shaw

[11] 4,058,988

[45] Nov. 22, 1977

[54] HEAT PUMP SYSTEM WITH HIGH EFFICIENCY REVERSIBLE HELICAL SCREW ROTARY COMPRESSOR

[75] Inventor: David N. Shaw, Unionville, Conn.

[73] Assignee: Dunham-Bush, Inc., West Hartford, Conn.

[21] Appl. No.: 653,568

[22] Filed: Jan. 29, 1976

[51] Int. Cl.[2] ..... F25B 29/00

[52] U.S. Cl. ..... 62/160; 62/196 A; 417/310

[58] Field of Search ..... 417/292, 282, 310, 315; 418/159, 201; 62/160, 229, 510, 196

[56] References Cited

U.S. PATENT DOCUMENTS

| | | | |
|---|---|---|---|
| 3,314,597 | 4/1967 | Schibbye | 418/159 |
| 3,432,089 | 3/1969 | Schibbye | 418/201 |
| 3,859,814 | 1/1975 | Grant | 62/196 |
| 3,885,938 | 5/1975 | Ordonez | 62/196 |
| 3,936,239 | 2/1976 | Shaw | 417/315 |

*Primary Examiner*—William E. Wayner
*Assistant Examiner*—Robert J. Charvat
*Attorney, Agent, or Firm*—Sughrue, Rothwell, Mion, Zinn and Macpeak

[57] ABSTRACT

A helical screw rotary compressor is provided with oppositely oriented slide valves at the suction and discharge sides of the machine to control compressor capacity and balance the closed thread pressure at discharge with discharge line pressure in a main closed loop heat pump refrigeration system. The compressor may be bidirectional if the function of the slide valves is reversed. Additional slide valves carried by the compressor may be employed to vary the injection point of intermediate pressure refrigerant gas to a compressor closed thread and to control flow to and/or from closed threads and a secondary loop for subcooling the main loop refrigerant or for other functions.

25 Claims, 3 Drawing Figures

HEAT PUMP SYSTEM WITH HIGH EFFICIENCY REVERSIBLE HELICAL SCREW ROTARY COMPRESSOR

BACKGROUND OF THE INVENTION

1. Field of the Invention

This invention relates to heat pump systems for selectively heating and cooling an environment or enclosure housing at least one heat exchange coil of the heat pump system, while rejecting heat or adding heat thereto by way of a second coil external of the enclosure and subject to ambient, and more particularly, to the employment of a multiple slide valve helical screw compressor within such heat pump system for improved efficiency and low operating costs.

2. Description of the Prior Art

With fossil fuel reserves diminishing rapidly, it is inevitable that this country and the world will shift more and more to central station electric power generating facilities. One of the major practical solutions to the heating and cooling requirements of this nation is the utilization of an extremely efficient, reliable and reasonably priced electrically driven heat pump. A heat pump, by its very nature, comprises a reversible closed loop refrigeration system in which a compressor within the loop compresses a gaseous refrigerant from low pressure to high pressure, a first coil downstream of the compressor condenses the gaseous high pressure refrigerant to a liquid and an expansion valve between the first coil and a second coil permits the high pressure liquid refrigerant to expand within the second and downstream coil for cooling the environment within which that coil is placed by way of the latent heat of vaporization of the refrigerant, with the refrigerant vapor returning through the closed loop to the compressor for recompression. Conventionally, such a compressor is driven in a single direction and in order to effect reverse heat pump operation wherein the first coil absorbs heat from the environment and the second coil rejects heat to effect condensation of the compressed refrigerant gas, a reversing valve is provided to connect the discharge of the compressor to the other of the two coils and the suction to the coil previously connected to the discharge.

Within recent years, the helical screw rotary compressor has come into vogue, the helical screw rotary compressor being an inherently reliable type machine having a volumetric efficiency which is characteristically best suited for heat pump service. In contrast to the typical reciprocating compressor, wherein the volumetric efficiency of the compressor deteriorates rapidly as the pressure ratio imposed upon it by the system increases, there is no such rapid deterioration in volumetric efficiency with a screw compressor. Thus, the screw compressor provides an ideal match for heat pump requirements in that as the ambient temperature falls during the heating season, the CFM pumped by the compressor does not deteriorate as would occur by a conventional, single stage reciprocating compressor.

Applicant in his prior application Ser. No. 492,084 entitled "Undercompression and Overcompression Free Helical Screw Rotary Compressor" filed July 26, 1974, and now U.S. Pat. No. 3,936,239 provides within such helical screw rotary compressor a slide valve member which controls the discharge pressure of the compressor and which includes a port opening to a closed thread adjacent to the end of the slide valve member closing off the discharge port to the closed thread for sensing that closed thread pressure and the helical screw rotary compressor further comprises means for controlling the shifting of that slide valve member to equalize these pressures and to thus prevent undercompression or overcompression of the compressor working fluid within the closed thread prior to discharge. The helical screw rotary compressor may be of the reversible type and may employ a second identically formed, axially shiftable slide valve member with the dual slide valve members interchangeably performing functions of compressor capacity control and prevention of undercompression or overcompression of the compressor.

In refrigeration and air conditioning systems, it is conventional to bleed a portion of the liquid, high pressure refrigerant downstream of the system condenser and expand that liquid refrigerant in a heat exchange coil operatively positioned with respect to the refrigerant line leading from the condenser to one or more of the evaporator coils for subcooling the condensed high pressure refrigerant prior to employing its energy content in cooling the evaporative load. Further, it is conventional to employ multiple evaporators tailored to the diverse cooling loads, in which case the vaporized refrigerant leaving the evaporator coils of the various evaporators and returning to the compressor are at different pressures.

It is therefore an object of the present invention to provide an improved heat pump refrigeration and heating system which employs a helical screw rotary compressor which will operate on either a heating or a cooling cycle with wide variation in ambient conditions and wide variations in compressor loading with no loss in efficiency.

It is therefore a further object of the present invention to provide a helical screw rotary compressor within a heat pump heating and cooling system which is characterized by a variable built in pressure ratio with the compressor automatically and completely adjusting to pressure conditions and loading conditions imposed on it by the refrigeration system.

A further object of the present invention is to provide an improved heat pump heating and cooling system which employs a helical screw rotary compressor which matches compressor discharge to line pressure, and wherein the return flow of refrigerant vapor from the subcooling or economizer coil or an intermediate pressure evaporator coil may be injected into a helical screw compressor closed thread intermediate of the suction and discharge ports of the compressor.

It is a further object of this invention to provide a helical screw compressor for use in a heat pump heating and cooling system wherein the compressor employs multiple, axially shiftable slide valves for: (1) controlling the capacity of the compressor; (2) matching the closed thread pressure of the compressor at discharge to the discharge line pressure; (3) controlling the point of injection of a refrigerant gas return from a subcooling or economizer coil or a high pressure evaporator coil depending upon system conditions; and (4) axially adjusting the point of working fluid vapor removal and return to compressor closed threads feeding a secondary closed refrigeration loop for subcooling the main loop refrigerant liquid or other function.

SUMMARY OF THE INVENTION

In one form of helical screw rotary compressor, an axially shiftable slide valve on the compressor carries a port which senses the pressure of the refrigerant working fluid in the trapped volume or closed thread just before uncovering of the closed thread to the discharge port and compares that pressure with line pressure at the discharge side of the compressor and automatically shifts the slide valve to balance the pressures and prevent overcompression or undercompression of the compressor. A second axially shiftable slide valve is employed on the same compressor acting in conjunction with the suction port for controlling the capacity of the compressor. Reversal of rotation or drive of the helical screws of the compressor may occur with the slide valves trading functions in a heat pump system, permitting the elimination of the reversing valve relative to the two primary heat exchange coils which alternately function as condenser and evaporator coils within the heat pump system.

DESCRIPTION OF THE PREFERRED EMBODIMENTS

Figure 1:
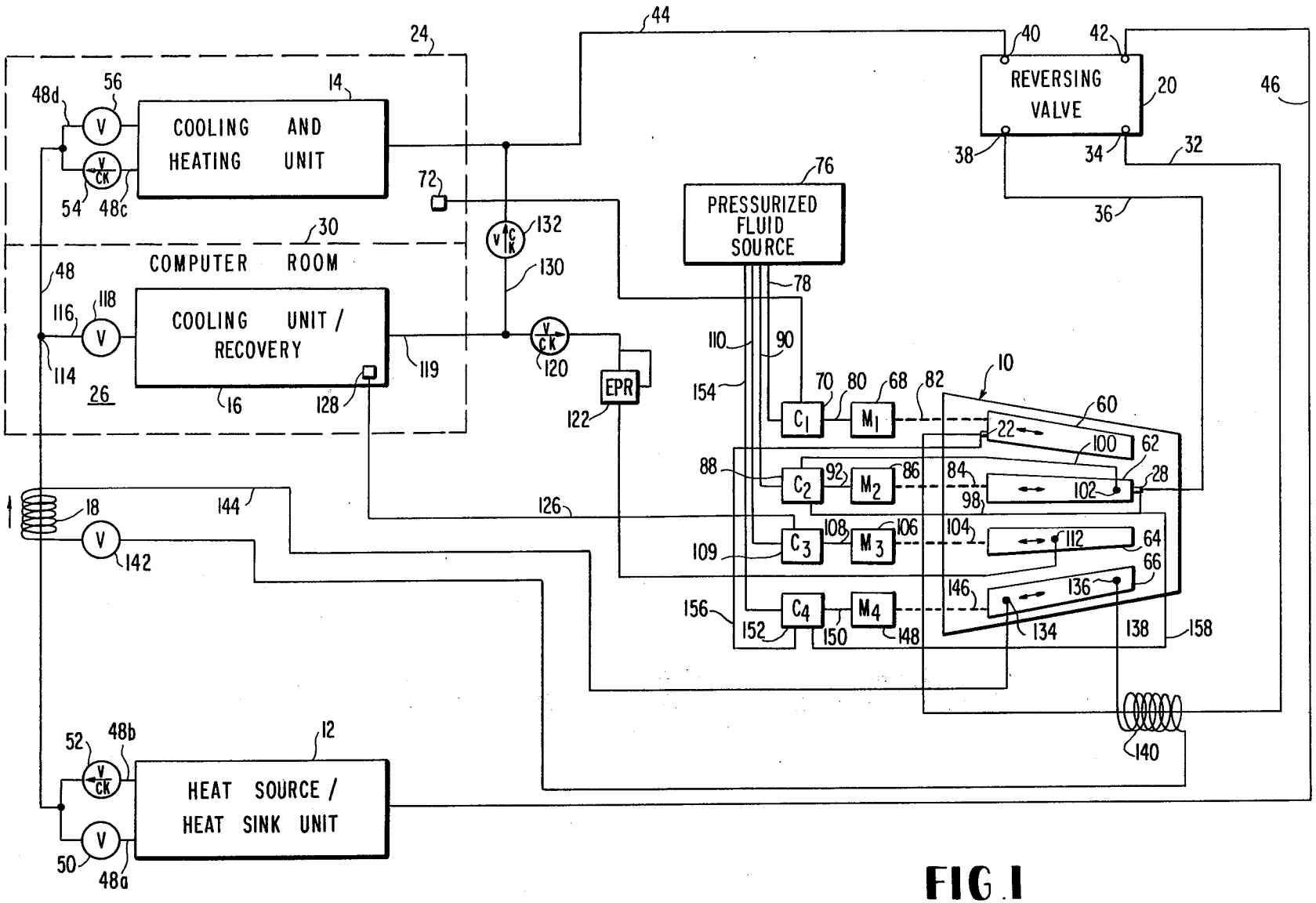
FIG. 1 is a schematic diagram of one embodiment of the improved heat pump heating and cooling system of the present invention employing a multiple slide valve helical screw rotary compessor under conditions where the system is cooling the enclosure being conditioned.

The present invention comprises an improved closed loop heat pump system wherein in the illustrated embodiment of FIG. 1 a helical screw rotary compressor 10 performs alternate heating and cooling functions involving two basic system heat exchangers, a cooling and heating coil or unit 14 for controlling the temperature of an enclosure indicated by dotted lines 24, and a heat source or heat sink coil or unit 12 which is subjected to the ambient for rejecting unwanted heat when cooling enclosure 24 and for picking up desired heat from the ambient when heating enclosure 24. The system is characterized by additional coils, i.e., a cooling unit/recovery coil 16 which may be employed in a liquid chiller for maintaining a relatively fixed temperature in a separate computer room 26 within the confines of the enclosure 24. The enclosure 24 housing the cooling and heating unit 14 is separated from computer room 26 by wall 30 illustrated by a dotted line. Further, a subcooling or economizer coil 18 is provided within the system for subcooling the liquid refrigerant passing from the heat source or heat sink 12 to the cooling and heating unit 14 or vice versa prior to expanding. To effect reversing of the function of coil 14, a reversing valve 20 is employed relative to the suction and discharge sides of the screw compressor 10. With these basic components of the system in mind, a detailed description of the heat pump follows.

The reversible helical screw rotary compressor 10 is a modified helical screw rotary compressor of the type shown in the referred to U.S. Pat. No. 3,936,239. In that regard, the compressor 10 is driven uni-directionally by an electric motor (not shown).

The compressor 10 is provided with a suction port 22 at the left end thereof and a discharge port 28 at the right end. Conduit or line 32 connects the suction port 22 to port 34 of the reversing valve 20. Further, the compressor discharge port 28 is connected by way of conduit or line 36 to the port 38 of the reversing valve. The reversing valve further includes ports 40 and 42, the port 40 being connected to the cooling and heating unit or coil 4 by way of conduit 44 and port 42 of the reversing valve being connected by way of conduit or line 46 to the heat source or heat sink unit or coil 12. A conduit 48 connects the heat source or heat sink coil 12 to the cooling and heating unit coil 14 and forms with the compressor 10 and the reversing valve a closed loop refrigeration circuit which is reversible by way of operation of reversing valve 20 which simply reverses the connections between ports 34–38 and 40–42 depending upon whether the heat pump system is operating under the cooling or heating mode.

The function and make-up of the reversing valve is conventional and simply reverses the flow of refrigerant discharged from the compressorat discharge port 28 relative to coils 12 and 14. Since the coils 12 and 14 alternately function as condenser coils and evaporator coils, conduit 48 is provided with parallel flow sections **48*a* and 48*b* opening to the heat source or heat sink coil 12 and parallel flow sections 48*c* and 48*d* opening to the cooling and heating unit coil 14. An expansion valve 50 is provided within conduit section 48*a*, a check valve 52 within conduit section 48*b*, a check valve 54 within conduit section 48*c* and expansion valve 56 within conduit section 48*d*. The expansion valves function when coils 12 or 14 are acting as evaporators to expand high pressure liquid refrigerant within the coils and to pick up heat at that point within the system, while the check valves function to force refrigerant flow through the expansion valves. When the coils 12 and 14** are functioning as condensers, the check valves automatically permit the high pressure condensed liquid refrigerant to pass through one unit and onto the unit performing an evaporator function.

In difference to the helical screw rotary compressor of the referred to application, compressor 10 is provided with four slide valves or members at 60, 62, 64 and 66. The function of the first slide valve 60 is to control the capacity of the helical screw rotary compressor, and in that regard, prevents admission of unneeded gas to the compressor rotors. The slide valve 60 is driven by a motor such as hydraulic motor 68 which in turn is controlled by a control device 70 which is load responsive. In this regard, the control 70, the motor 68, and the slide valve 60 are conventional, both in terms of construction and operation. For instance, the control device 70 may receive a temperature signal as from thermal bulb 72 mounted within the enclosure 24 to sense basic system load and control hydraulic fluid, for instance, from a source 76 through line 78 and from control unit 70 through line 80 to the motor 68 which directly drives the slide valve 60 through a mechanical connection 82.

Figure 2:
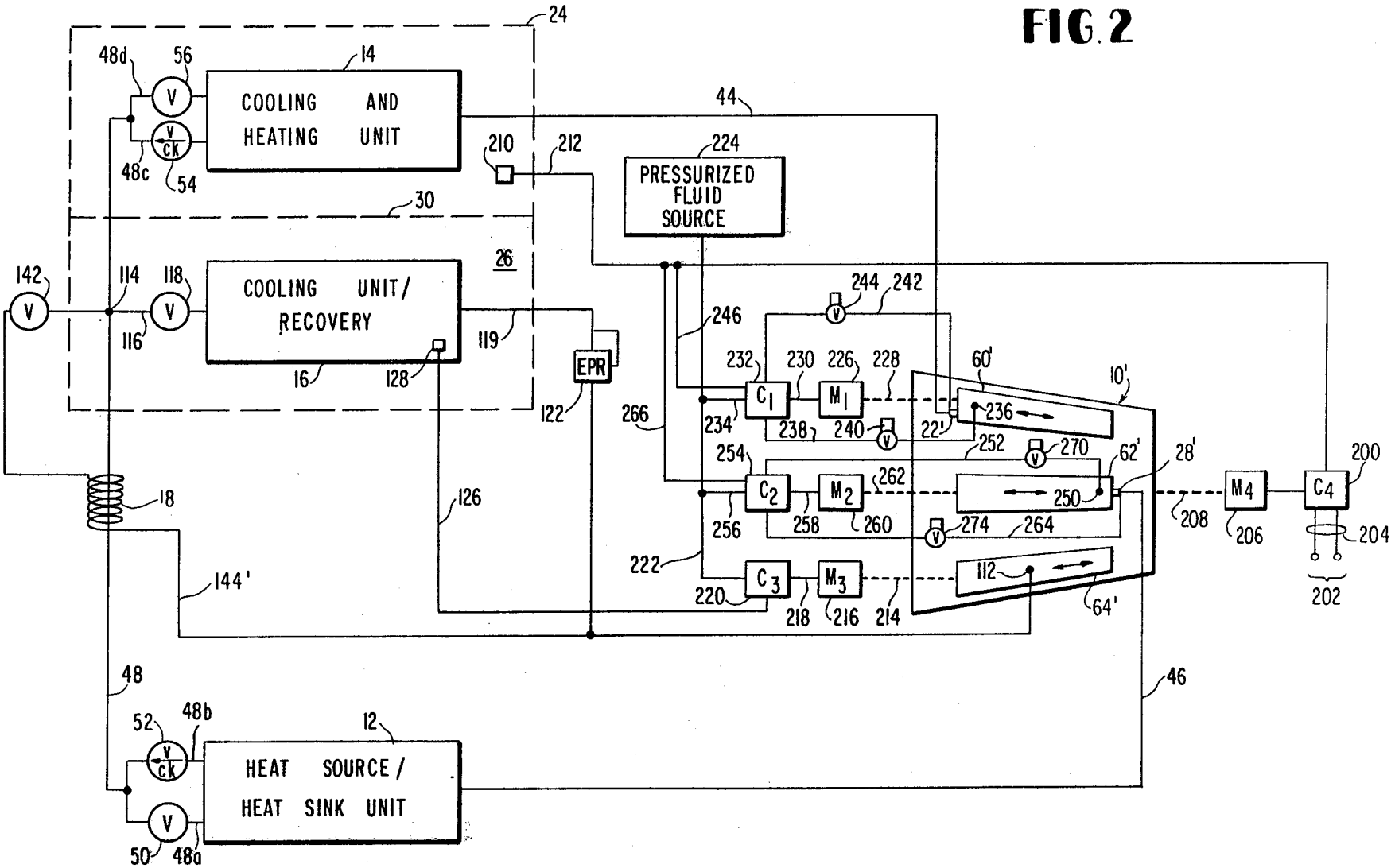
FIG. 2 is a schematic diagram of a second embodiment of the present invention, with the improved heat pump system performing a cooling function.
Figure 3:
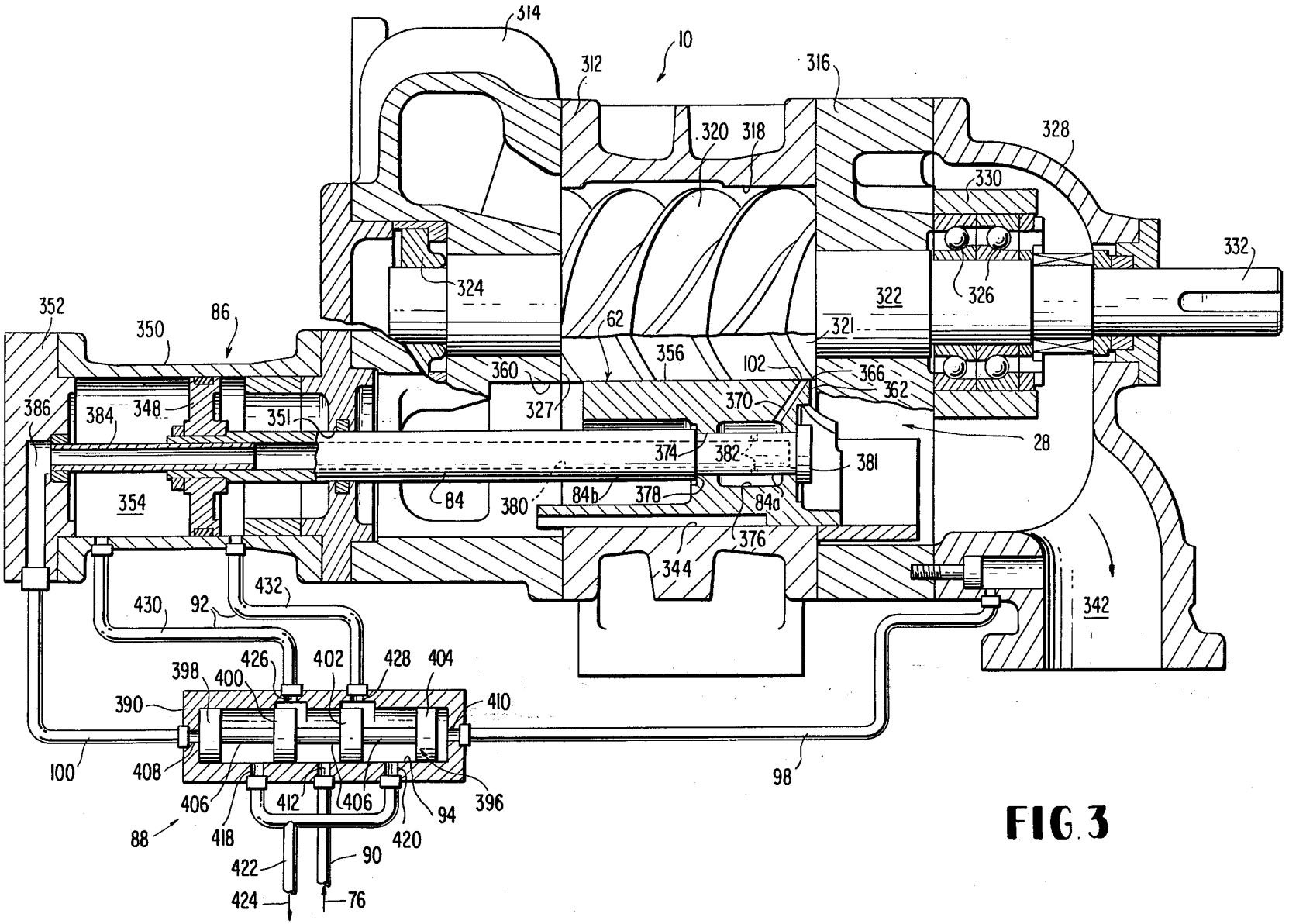
FIG. 3 is a sectional view of the rotary helical screw compressor forming a component of the system of FIG. 1 and illustrating the slide valve member which matches the closed thread pressure at the discharge side of the machine to the discharge line pressure at the discharge port.

Further, in terms of U.S. Pat. No. 3,936,239 slide valve 62 controls the point at which the closed thread forming the compression chambers between the helical screws, opens to the discharge port 28 of the screw compressor, and in that regard, the slide valve 62 is shifted axially by way of mechanical connection 84 and hydraulic motor 86 responsive to the operation of a control device 88. Device 88 supplies hydraulic fluid or the like through line 92 to the motor 86, which fluid emanates from source 76 via line 90 in response to the comparison between a closed thread gas pressure at the point of discharge and the discharge pressure within line 36 at the compressor discharge port 28. In order to do this, line 98 leads from the discharge port 28 to the control device 88, while another line 100 fluid connects a sensing port 102 within the slide valve 62 and open to the closed thread, to the control device 88 which includes the means for comparing these pressures and supplying in a selective manner hydraulic fluid to the hydraulic motor 86 controlling the position of the slide valve 62. The function, make-up and operation of slide valve 62 is only briefly referred to in this patent, since the details thereof are readily found within the referred to patent above. However, reference to FIG. 3 shows in accordance with U.S. Pat. No. 3,936,239 the slide valve member 62 of FIG. 1 mounted to helical screw compressor 10 and axially slidable and employed to match the closed thread pressure just before discharge within a closed thread to that of the discharge pressure at discharge port 28 of the machine, the slide valves 60, 64 and 66 being similar thereto. However, slide valves 64 and 66 in this embodiment being modified only to the extent that the slide valve itself completely seals off the recess or opening within the casing covered by the slide valve, regardless of the axial position of the slide valve, so that the slide valve completes the envelope of the chamber housing the intermeshed screws and maintains that envelope sealed from the casing exterior regardless of the axial shifted position of the slide valves 64 and 66. In FIG. 3, the rotary, helical screw compressor 10 constitutes a casing structure having a central barrel portion 312 located between end wall sections or portions 314 and 316 and providing a working space formed by two intersecting bores (of which bore 318 is illustrated) and which carries a helical screw rotor 320 in mesh with the second helical screw rotor 321 which has an axis coplanar thereto and extending through the barrel portion 312 of the casing structure. The screw rotor 320 is mounted for rotation on shaft 322 by being supported within bearing 324 of an end wall portion 314, while shaft 322 is supported by way of anti-friction bearings 326 carried by end wall portion 316 and mounted within an end bell 328 by way of a sleeve 330; shaft 322 extending through the end bell 328 and being splined at 332 to permit the screw compressor to be coupled to an electric motor, such as motor 206 in the embodiment of FIG. 2, which motor constitutes the motive source for driving the screw compressor.

Important to the present invention, the barrel portion 312 of the casing structure is further provided with a centrally located, axially extending, cylindrical recess 344 which is in open communication, at one end, with the high pressure discharge port 28 and at the other end extends axially beyond the low pressure end wall 327. The recess 344 therefore is open to the working space provided by the bores. It is this recess 344 which carries the longitudinally slidable, slide valve member 62. The axial position of the slide valve member 62 within the recess is adjusted by way of piston rod or mechanical connection 84 between the slide valve member 62 and the hydraulic fluid motor 86, including a power piston 348 which piston is fixed to the opposite end of rod 84 from slide valve member 62. The power piston 348 is sealably and slidably supported within a power piston cylinder 350 which is mechanically coupled to the low pressure end wall portion 314 of the casing structure and is sealed therefrom by way of the piston rod 84 which slidably extends through an opening 351 within the end wall casing structure portion 314, and end cap 352 is mechanically coupled to the end of cylinder 350 so as to form a sealed chamber 354 within the cylinder which slidably receives piston 348. The inner surface 356 of the slide valve member 62 confronting the rotors is shaped to provide a replacement for the cut-away portions of the casing which defines the bores. A portion of the slide valve member 62 slidably and sealably engages a recess portion 360 of the end wall portion 314 of the casing such that regardless of the position of the slide valve, the valve member is of sufficient length to cover the entire remaining length of the confronting portion of the rotor structure throughout its range of movement between the extreme positions as determined by recess portion 360 and the abutting contact or end face 362 of the slide valve, with the high pressure end wall portion 316 of the casing structure. The slide valve member 62 is automatically shifted to match the closed thread or working chamber fluid pressure at its point of discharge as determined by edge 366 of the slide valve member 62, to the line pressure of the working fluid at the compressor discharge port 28. In this respect, the slide valve member 62 is provided with an inclined passage 370 forming at the inner surface 356 of the slide valve member, a closed thread sensing port 102 which opens to the closed thread and permits sampling of the pressure of the compressed working fluid at that point in the compression cycle and just prior to discharge. The slide valve member 62 is further bored at 374 and is provided with an annular recess 376 forming aligned openings through which extend the smaller diameter portion **84*a* of the piston rod 84. The large diameter portion 84*b* of this piston rod forms a shoulder 378 which acts in conjunction with the headed end 381 of the shaft to lock the piston rod or shaft 84 to the slide valve member 62. The piston rod 84 is centrally bored at 380 extending almost the full length of the rod but being closed off at the enlarged headed end 381. A plurality of radial holes 382 are bored within the piston rod 84, fluid communicating the bore 380 of the piston rod with the cavity within the slide valve member 62, defined by the recess 376 and which opens up to the sensing port 102 via passage 370. Piston rod 84 carries at its opposite end in telescoping fashion a fixed tube 384 which is supported by bore 380 and which is fixed and fluid sealed to the end cap 352, a fluid passage 386 within the end cap is coupled by way of line 100 to the pilot valve casing 390 of the pressure comparing means or pilot valve 88. The pilot valve 88 carries a longitudinal bore 94 within which lies a pilot valve spool 396 comprising four lands 398, 400, 402 an 404, which are slightly less in diameter than bore 394 within the valve casing. The lands are joined by reduced diameter portions 406. In addition to axial ports 408 and 410, an inlet port 412 fluid connects a line 90 from a supply indicated by arrow 76, while ports 418 and 420 are fluid connected to a common discharge line 422 discharging fluid from the pilot valve 88 as indicated at 424. On the opposite side of the valve casing 390 are provided fluid ports 426 and 428 which lead by way of lines 430 and 432, respectively, to chamber 354 carrying the power piston 84; and to respective sides of the power piston 348. The cavity or chamber 354 is fluid sealed from the bore 380 of the piston rod 84. The pilot valve and the power piston comprise a fluid servo circuit of conventional design with the pilot valve 88 performing the pressure matching function for the system. Hydraulic liquid constituting a motive fluid as indicated by arrow 76 is selectively applied to either the left or right hand side of power piston 348, while the hydraulic liquid on the opposite side is drained by way of pilot valve 88 to the discharge line 422 and fed back to the sump (not shown), as indicated by arrow 424 from port 418 or port 420** as the case may be.

In the present invention, the line 100 fluid couples the closed thread sensing port 102 to the left hand face of land 98 of the valve spool of the pilot valve or pressure comparing means. The opposite axial port 410 is fluid coupled by way of line 98 to the discharge passage 342 which opens to the discharge port 28 of the helical screw compressor 10. This permits the discharge gas line pressure to be applied to the valve spool 396 and in particular to the outboard end face of land 404. With the end face surface areas of lands 398 and 404 being identical, the valve shifts to the right or to the left depending upon whether the pressure within the discharge passage 342 of the compressor is higher than the pressure within the closed thread as sensed by port 102 at any instant or vice versa. Thus, slide valve member 62 is shifted to prevent overcompression and undercompression automatically under control of a hydraulic servo system responsive to a control input in this case the differetial between the closed thread pressure at the point of discharge and the actual discharge pressure at the discharge port of the compressor. In like fashion, each of the slide valve members 60, 64 and 66 of compessor 10 of the embodiment of FIG. 1 and slide valve members 60', 62' and 64' of the embodiment of FIG. 2 are mounted for shifting axially relative to the longitudinal axis of the compressor in each case, and overlie axially extending recesses within the casing of those members which open to the intermeshed helical screws of respective compressors.

As mentioned previously, the improved heat pump system of the present invention employs a cooling unit or recovery coil 16 for maintaining a fixed temperature within a computer room or the like 26, separated from the main enclosure 24 which is heated and cooled depending upon outside ambient. Regardless of the time of year, heat is constantly removed from the computer room 26. Alternately, the function of coil or unit 16 could be to recover heat from some other source within the environment of the enclosure 24 whose temperature is to be maintained at a predetermined level or from a solar collector. Further, to maximize the efficiency of the system, an economizer or subcooling coil 18 is positioned in heat exchange position with respect to conduit 48 coupling coils 12 and 14, this subcooling or economizing coil or loop 18 functioning to subcool high pressure liquid refrigerant regardless of the direction of flow within line 48, that is, whether unit 12 or unit 14 is functioning as an evaporator coil. The functions of the third and fourth slide valves 64 and 66 are, respectively, to control the injection of the refrigerant gas or vapor recovered from the cooling unit 16 and to eject and inject refrigerant gas at intermediate pressures relative to the suction and discharge ports 22 and 28 of the compressor for the subcooling function, etc. Both slide valves sealably cover the casing.

In this respect, the slide valve 64 is mechanically coupled by connection 104 to the hydraulic motor 106, which by way of conduit 108 receives a hydraulic fluid under pressure from source 76 via control device or unit 109 which is connected thereto by line 110. The slide valve 64 is axially shiftable to vary the point of injection of an injection port 112 within the slide valve 64 opening to a closed thread within the helical screw compressor 10. The cooling unit or recovery coil 16 is connected to conduit 48 at point 114 intermediate of coils 12 and 14 by way of conduit 116. The conduit 116 carries an expansion valve 118 which causes expansion and pressure reduction of the liquid refrigerant for maintaining the temperature within the computer room 26 at its predetermined temperature while discharging vaporized refrigerant by way of return conduit 119 from that coil at a pressure high than the closed thread pressure of the compressor injection port 112 of the screw compressor. The return conduit 119 terminates at the injection port 112 within slide valve 64. Conduit 119 carries between the coil 16 and the slide valve 64, a check valve 120 permitting flow of intermediate pressure gas from the unit or coil to the compressor slide valve 64 but not in the reverse direction. Conduit 119 further includes an EPR valve 122 downstream of the check valve 120 whose function is to limit the return of intermediate pressure vapor or refrigerant gas from coil 16 to a compressor closed thread by way of injection port 112 and maintain a given pressure within coil 16. The EPR valve is conventional in construction and function within the refrigeration industry. The EPR valve may be eliminated where refrigerant gas is injected into the compressor by a shifting slide valve, as in this case. In order to optimize recovery operation, slide valve 64 is shifted axially to vary the position of the injection port 112. In this case, the control device 109 receives a signal through line 126 which terminates in a thermal bulb 128 thermally positioned relative to the cooling unit coil 16. For instance, if cooling unit 16 comprises a liquid chiller, the thermal bulb 128 may measure the temperature of the chiller water and control shifting of the slide valve 64 appropriately such that as the temperature of the chiller liquid decreases, the slide valve 64 is moved closer to suction, thereby causing increased flow of the refrigerant gas being returned by way of conduit 119 to the closed thread within the compressor receiving the gas.

Under conditions, as shown in FIG. 1, where coil 14 is functioning as a cooling coil and delivering relatively low pressure refrigerant vapor through conduits 44 and 32 to the compressor suction port 22, a shunt line or conduit 130 fluid connects conduits 119 and 44 upstream of check valve 120 and intermediate of coil 14 and reversing valve 20, the shunt line 130 including a check valve 132 whose function is to permit refrigerant vapor to flow from line 119 to line 44 but not vice versa. This allows for unusual peak loads when in a cooling mode.

The fourth slide valve 66 of the screw compressor provides a unique function within the helical screw rotary compressor, that is, it functions both to eject compressor working fluid and to inject the same at pressures intermediate of the suction and discharge pressures of the machine and it is particularly useful for subcooling the liquid refrigerant within the system main loop. In this respect, slide valve 66 is provided with a low pressure injection port 134 and a high pressure ejection port 136 located at longitudinally spaced positions and opening respectively to different closed threads or compressor chambers formed between the intermeshed helical screws within the screw compressor 10. The high pressure ejection port 136 causes high pressure refrigerant vapor or gas to pass by way of line or conduit 138 to the subcooling or economizer coil 18. This refrigerant gas is first liquified with coil 140 by way of heat exchange with the main loop suction line 32 leading from the reversing valve 20 to the compressor suction port 22. Coil 140 therefore comprises a superheat coil functioning essentially as a condenser for gas which is then expanded by way of expansion valve 142 within coil 18 prior to flowing in parallel flow with conduit 48, and subcooling the liquid refrigerant within conduit 38, whereupon the vaporized refrigerant gas within coil 18 is returned by way of return line 144 to the lower pressure injection port 134 of slide valve 66.

In order to control the position of the fourth slide-valve 66, it is envisioned that that slide valve is mechanically connected by way of dotted line connection 146 to a hydraulic motor 148 or the like which is fluid connected by conduit 150 to control device 152. The control device 152 is connected to the source of hydraulic pressurized fluid 76 thrugh line 154 and the control of the application of the hydraulic liquid to the motor 148 is achieved by a pressure of the $\Delta\rho$ or pressure differential between the suction and discharge sides of the helical screw compressor 10. In that regard, a line 156 branches from line 32 leading to the suction port 22, and provides one input to the control device 152 while a branch line 158 leads from the pressure sensing line 98, open to the discharge port 28 and passing to the control device 88, for supplying to the control device 152 a measure of the compressor discharge pressure at port 28. Thus, under conditions where the compressor is unloaded and the pressure differential decreases between suction port 22 and discharge port 28, a control signal would emanate within line 150, causing the hydraulic motor 148 to shift the fourth slide valve 66 longitudinally to the left, thereby reducing the $\Delta\rho$ and the volume of gas flow in the closed loop through lines 138 and 144 and thus reducing the subcooling effect of the subcooling coil 18. In a modified version of a slide valve such as slide valve 66, the injection port 134 may be eliminated and ejection port 136 provides a variable tap point for picking off compressed refrigerant gas prior to discharge at discharge port 28 of the machine within a given closed thread and feeding gas first to superheat coil 140 and to coil 18 for expansion with its return occurring by way of line 119 downstream of coil 16. Control of ejection port position would preferably be in response to a change in $\Delta\rho$ for the compressor, that is, a change in the pressure differential between the suction and discharge sides of the machine.

The operation of the embodiment of the invention illustrated in FIG. 1 should be readily apparent from the above description. However, briefly with the heat pump system operating under a full cooling cycle, the reversing valve connections are with flow from conduit 40 to conduit 32 via ports 40 and 34 thereby supplying vaporized refrigerant from unit 14 acting as an evaporator coil to the suction port 22 of the machine, while ports 38 and 42 are fluid connected by the reversing valve 20 such that compressed refrigerant gas discharging from the compressor at compressor port 28 flows by ways of conduit 36 to conduit 46 and thence to the coil 12 acting as the condenser and positioned within the ambient. Condensed liquid refrigerant at high pressure passes through conduit section **48*b* and check valve 52 to conduit 48 where it passes through conduit section 48*b* and expansion valve 56 and cools enclosure 24 by the latent heat of vaporization of the liquified refrigerant. It is thence returned by line 44 to the compressor suction port 22. During this operation, slide valve 60 controls the capacity of the machine responsive to compressor load. Slide valve 62 matches the compressor discharge port pressure at discharge port 28 with a closed thread just before the point of discharge by way of sensing port 102** to prevent the compressor from either overcompressing or undercompressing the working fluid.

Further, the computer room 26 is being cooled by coil 16 which always functions as an evaporator coil regardless of whether the heat pump is operating under full cooling cycle or under full heating cycle and receives liquid refrigerant through line 116 from line 48, whereby, by means of expansion valve 118 the refrigerant is reduced to an intermediate pressure in terms of suction and discharge pressures of the compressor 10 picking up heat from computer room 26, whereupon vaporized refrigerant passes by way of return line 119 through check valve 120, back to the compressor by way of injection port 112 within the third slide valve 64. The position of the injection port 112 and the point of return of the vaporized refrigerant from coil 16 is dependent upon the chiller water temperature of that unit, sensed by thermal bulb 128 and providing a control signal through line 126 to control device 108.

Subcooling is accomplished in terms of the liquid refrigerant discharging from coil 12 at the check valve 52 by way of subcooling or economizer coil 18 which surrounds conduit 54 in heat transfer position upstream of tap point or connection 114 for the computer room coil 16. The ejection port 136 supplies gaseous or vaporized refrigerant at a relatively high pressure to line 138 where the vapor condenses within superheater 140 as result of heat exchange between that coil and the suction return line 32 leading to the compressor suction port 22 for the main loop refrigerant flow, the condensed liquid refrigerant at relatively high pressure expanding at expansion valve 142 and performing cooling of the liquid refrigerant within conduit 48 upstream of unit 14 acting in this case as an evaporator coil and tap point 114. The closed loop return is made by way of return line 144 to the injection port 134 of the fourth slide valve 66. As the machine load varies, sensed by a comparison between suction and discharge pressures of the machine, the fourth slide valve 66 will shift in response thereto to vary the position of ejection and injection ports 136 and 134 respectively relative to separate closed threads or compression chambers of screw compressor 10, thus controlling the flow rate of refrigerant through the secondary loop incorporating the subcooling or economizer coil 18.

During reverse operation and full heating cycle operation, coil 14 acts as a heating unit for enclosure 24 and coil 12 functions as an evaporator coil within the ambient, the reversing valve reversing the connections between the discharge port 28 and coil 12 and suction port 28 and coil 14. Coil 14 then functions as a condenser coil and coil 12 as an evaporator coil. During this operation, high pressure liquid refrigerant discharging from coil 14 passes through the check valve 54 and conduit section **48*c* to line 48, where it is subcooled by way of loop 18 prior to expanding at expansion valve 50 within conduit section 48*a* causing heat to be picked up by coil 12** acting as a heat source and functioning as an evaporator within the ambient. The operation of the subcooling coil 18 and the computer room cooling coil 16 remains identical to that operation under full cooling cycle previously described.

It should be remembered that when coil 14 is functioning as a cooling unit for enclosure 24, refrigerant flow within coils 14 and 16 is in parallel, and check valve 132 permits refrigerant vapor to flow directly through conduit 44 to the suction port 22 of the machine from both coils 14 and 16. However, when coil 14 is functioning as a condenser and receives the discharge of the compressor, the check valve 132 prevents reverse flow through shunt line 130, and in this case, the return from coil 16 which continues to function as an evaporator coil for cooling the computer room 26, must be through line 119, check valve 120, EPR valve 122 and the injection port 112 of slide valve 64. The function of the EPR valve under the full heating cycle is to prevent the recovery cooling unit 16 pressure from dropping too low. Further, during the full heating cycle, it should be noted that flow through the subcooling coil 18 is in counterflow with respect to the liquid refrigerant within conduit 48 from the unit 14 acting as a condenser to unit 12 acting as an evaporator.

The system described above provides a highly efficient utilization of available energy. Further, while the illustrated embodiment employs four separate slide valves, it may be seen that it is possible that the fourth slide valve 66 may be eliminated and in which case it is desirable that the subcooling coil 18 be fluid connected to conduit 48, at tap point 114 or any other point intermediate of the coils 12 and 14 to receive liquid refrigerant, and an expansion valve be placed between that tap point and the coil with the return from coil 18 of vaporized refrigerant opening to return line 119 downstream of check valve 120 and EPR valve 122 but upstream of the injection port 112 of the third slide valve 64. Obviously, under this modification, the position of the slide valve 64 and the injection port 112 will again be dependent upon the water temperature of coil 16 as sensed by thermal bulb 128. Alternatively, the third slide valve 64 could be provided with two injection ports, one at 112 for injection of gas from coil 16 while the other longitudinally spaced therefrom which could receive, through the subcooler return line, refrigerant vapor for injection into a closed thread separate from that receiving the vaporized content return of the coil 16 at a somewhat different pressure. However, the more thermal dynamically acceptable solution is to separate the functions of the recovery unit slide valve 64 from the economizer coil or loop 118 through the incorporation of a fourth slide which always properly locates the injection port for the economizer loop in order to maximize cycle efficiency.

Referring to FIG. 2, there is shown a second embodiment of a closed loop heat pump system employing in this case a bidirectional or reversible helical screw rotary compressor which eliminates the necessity for a reversing valve employed in the first embodiment. Like elements are given like numerical designations to those appearing in FIG. 1. The helical screw compressor 10' performs the function of driving the refrigerant working fluid bidirectionally through the closed loop including units or coils 12 and 14, the working fluid comprising a conventional refrigerant such as R-22 Freon. A suitable controller 200 controls electrical energy from source 202 through lines 204 to electric motor 206 which is mechanically connected by way of shaft 208 to the helical screw rotary compressor 10', the controller 200 functioning to reverse the connections between source 202 and the windings of motor 206 to effect reversing of the compressor, such action occurring at the time when the necessity for cooling enclosure 24 ceases and heating of that enclosure is initiated, and vice versa. For instance, a room thermostat 210 mounted within enclosure 24 provides a control signal through line 212 leading to the controller 200 causing the motor to be energized and to reverse its direction of rotation at a predetermined temperature. The system in FIG. 2 is in many respects identical to that of FIG. 1. Element 12 comprises a combined heat source or heat sink coil or unit which is positioned external of enclosure 24 within the ambient, while element 14 comprises the combined cooling and heating unit or coil within the enclosure 24 and functions either as a condenser or evaporator, depending upon whether the system is under a full heating or full cooling mode. Further, the system includes a cooling unit or recovery coil 16 which constitutes in similar fashion to the embodiment of FIG. 1, an evaporator coil which functions continuously to maintain the temperature below that of the enclosure 24 within computer room or the like 26 separated from the remainder of the enclosure 24 by wall 30. Further, the economizer or subcooling coil 18 is in heat transfer position with respect to conduit or line 48 which fluid connects coils 12 and 14 by surrounding the same. In the case of the economizer coil 18, a secondary refrigerant loop is not provided by way of a slide valve having an injection and ejection port in closed loop fashion as shown in the embodiment of FIG. 1, and the fourth slide valve is eliminated. There are three slide valves provided for the helical screw rotary compressor 10', slide valve 60', slide valve 62', and slide valve 64'. In this case, since the helical screw rotary compressor is reversible and in fact reverses to change the system from full cooling mode to full heating mode, the slide valves 60' and 62' periodically exchange their functions relative to ports 22' and 28' on respective ends of the machine. When in the cooling mode, port 22' functions as a suction port and port 28' functions as a discharge port, while the reverse is true when the motor is reversed and the system is operating under a heating mode, wherein coil 14 functions to reject heat into the enclosure 24 picked up from the ambient by way of coil 12 which functions in this case as a evaporator coil for the main refrigeration loop. Under conditions where the heat pump system is functioning under full cooling mode and heat is being extracted from the enclosure 24 slide valve 60' acts as a capacity control slide valve for the screw compressor 10', and functions to return a portion of the gas passing through the compressor back to the suction port 22' or suction side of the machine while slide valve 62' functions to match closed thread pressure of that thread just ready to open to the discharge side of the machine with compressor discharge pressure at port 28' which is then acting as a discharge port. When the screw compressor rotation is reversed, slide valve 60' and slide valve 62' trade functions. That is, slide valve 62' functions to vary the capacity of the machine by returning a portion of the gas now being fed through line 46 from coil 12 acting as an evaporator coil to port 28' which acts as a suction port for the machine. At the same time, slide valve 60' is acting to match the compressor discharge pressure with the pressure of the compressor working fluid within the closed thread just before the point of discharge to prevent undercompression or overcompression of the gas by the machine. Further, slide valve 64' functions under either mode to inject refrigerant vapor or gas in a common return line with respect to coil 16 within the computer room 26 and the subcooling or economizer coil 18.

For a fuller description of this embodiment of the invention, the main closed loop refrigeration circuit involves line 46 emanating from port 28' on the right side of the compressor 10' and opening to coil 12. A pair of conduit sections **48*a* and 48*b* lead from unit 12 to a common conduit or line 48 which fluid connects coil 12 to coil 14 by way of further parallel conduit sections 48*c* and 48*d*, the conduit sections functioning identically to the embodiment of FIG. 1 with conduit section 48*a* and 48*d* each including an expansion valve as at 50 and 56 respectively, while conduit sections 48*b* and 48*c* include check valves 52 and 54. As mentioned previously, conduit 44 connects the coil 14 within the enclosure 24 to port 22' of the compressor 10' at the left side thereof. The tap point 114 within conduit section or line 48 performs two functions. It bleeds off liquid refrigerant regardless of cooling or heating mode and supplies the same through expansion valve 142 to the subcooling or economizer coil 18 with refrigerant gas at intermediate pressure returned to compressor 10' through line 144'. Further, tap point 114 permits by way of conduit 116 some liquid refrigerant at high pressure to pass to the cooling unit 16 via expansion valve 118 to effect the maintenance of the computer room 26 at a lower temperature than that of enclosure 24 and thus continue to extract heat therefrom which passes from the higher temperature enclosure 24 to the computer room forming a portion thereof through a wall 30. Line 119 connects to the downstream side of coil 16 and includes an EPR valve 122 therein which functions identically to the EPR valve 122 in the embodiment of FIG. 1. However, in this case, line 119 joins return line 144' which is ported by way of injection port 112 within slide valve 64' to a closed thread within the compressor 10' at a pressure intermediate of compressor suction and discharge pressure regardless of the direction of rotation of the helical screw. The slide valve 64' is connected by way of mechanical connection 214 to a hydraulic slide valve drive motor 216 which receives hydraulic fluid by way of line 218 from a control device 220 fluid coupled by way of supply line 222 to a source of pressurized hydraulic fluid 224. The feed of such hydraulic fluid by the control device 220 is in response to the temperature of the cooling unit which may take the form of a chiller as in the first embodiment, in which case a thermal bulb 128 which may be immersed in the chiller liquid and feeds a signal through line 126 to the control device 220 controlling the supply of hydraulic fluid under pressure to the motor 216 for driving the slide 64' longitudinally and thus varying the position of the injection port 112. The control device 220 is appropriately provided with a mechanism for sensing the direction of rotation of the helical screw compressor 10' such that regardless of the direction of that rotation, the slide valve 64' is shifted appropriately depending upon whether the cooling unit coil 16 has its load increased or decreased to appropriately match the point of gas injection through injection port 112 with a closed thread pressure within the compressor 10' at said injection port 112**.

Turning again to the first and second slide valves 60' and 62', respectively, these slide values may be similarly shifted in the appropriate direction and under conditions wherein they function either as capacity control slide valves or pressure matching slide valves respectively. In this regard, slide valve 60' is mechanically coupled to its drive motor 226 by mechanical connection 228, the motor 226 being a hydraulic motor and receiving hydraulic fluid for driving the same by way of line 230 emanating from control unit 232. In turn, the control unit 232 receives high pressure hydraulic fluid from the pressurized fluid supply 224 by way of line 234 which branches from line 222. A closed thread pressure sensing port 236 on the slide 60' provides a pressure control signal through line 238 to the control unit 232, this line being shown as capable of being closed by a solenoid valve 240. This pressure is matched against compressor discharge pressure from port 22' by sensing that pressure through line 242 likewise controlled by a solenoid valve 244, the line 242 terminating at the control unit 232. Further, when valve 60' is functioning as a capacity control valve relative for bypassing or returning a portion of the gas back to the suction side of the machine, in this case port 22', solenoid valves 244 and 240 are closed and the only control signal to the control device 232 is a signal through line 246 which leads to thermostat 210 within enclosure 24, the compressor acting under cooling mode to provide hot compressed refrigerant vapor to coil 12 functioning as a condenser within the ambient.

Slide valve 62' is similarly constructed but operates in the opposite sense. That is, it is provided with a closed thread pressure sensing port 250 which feeds a pressure signal through line 252 to its control device 254 which receives hydraulic fluid through line 256 connected by way of line 222 to the pressurized fluid source 224, this fluid being delivered by way of line 258 to motor 260 which is mechanically connected at 262 to the slide valve 62'. In order to effect movement of slide valve 62' when it functions to match compressor discharge pressure with the closed thread pressure, line 264 is connected to the port 28' and includes solenoid valve 274 and provides a comparison signal to the pressure of the closed thread by way of sensing port 250 within slide valve 62'. Line 266 leads from enclosure thermostat 210 to the control device 254 for providing a control signal indicative of compressor load and thus effecting slide valve shifting of slide valve 62' longitudinally to vary the capacity of the machine when the machine is operating under full heating mode with coil 14 acting as a condenser. Appropriate solenoid valves 270 and 274 are provided within lines 252 and 264 respectively, which permit selective input to the control device, depending upon whether the machine is operating in one direction or the other. Energization of the solenoid valves 240 and 244 as well as valves 270 and 274 are effected by a master system control device (not shown).

From the above description, the operation of the second embodiment is believed sufficiently evident. However, a brief description of specific operation under both full heating and full cooling modes will now be described.

Assuming that the heat pump system is operating under a full cooling mode wherein enclosure 24 is being cooled by the absorption of heat within coil 14 and at the same time coil 16 is functioning to absorb heat within the computer room 26, the compressor operation is such that slide valve 60' is functioning to control the capacity of the machine, slide valve 62' is functioning to match compressor discharge pressure at port 28' with that pressure of the closed thread just before the point of opening to port 28' and slide valve 64' is functioning to return refrigerant vapor for injection into a closed thread by way of injection port 112 which essentially matches closed thread pressure and is responsive to the chiller water temperature associated with coil 16. Refrigerant vapor at high pressure discharged from the machine at port 28' and delivered by way of conduit or line 46 to coil 12 is condensed by rejecting heat to the atmosphere, the liquid refrigerant passes by way of check valve 52 within conduit section **48*b* to conduit 48, whereupon a portion of the same is bled through expansion valve 142 and subcooling coil 18 for cooling the liquid refrigerant upstream of tap point 114, while a second portion of the bled liquid refrigerant from conduit or line 48 at tap point 114 is expanded by way of expansion valve 118 within coil 116 to remove the heat from the computer room 26, the vaporized refrigerant returning by way of lines 119 and 144' leading from the subcooling or economizer coil 18 to the injection port 112 of slide valve 64' for injection into a closed thread at an intermediate pressure relative to the suction and discharge pressures of the machine. In this embodiment, the thermal bulb 128 controls the point or position of port 112 at which the vapor is injected back into the compressor, the slide valve 64' and the injection port 112 not taking into consideration the conditions of that portion of the vapor returned to the common circuit by way of line 144' from coil 18. Slide valve 62' under this set of operating conditions functions to shift under control of control device 254 matching the closed thread pressure as sensed by sensing port 250 just before discharge of the compressor with the compressor discharge pressure at port 28' by way of lines 252 and 264. Further, under these conditions, for slide valve 62', the solenoid valves 270 and 274 are open. With respect to slide valve 60', the solenoid valves 240 and 244 are closed, and the slide valve 60' varies the capacity of the compressor in response to load as sensed by enclosure thermostat 210. In the meantime, the major portion of the liquid refrigerant at high pressure within conduit 48 passes by way of expansion valve 56 in conduit section 48*d* to the coil 14 functioning as a cooling unit with respect to the enclosure 24 and removing heat therefrom by the latent heat of vaporization of the refrigerant, the resulting vapor returning by way of line 44 to port 22'** acting as a suction port for the machine.

Under conditions of operation where the thermostat 210 senses the need for motor reversal and full heating mode, the signal through line 212 will cause the controller 200 to reverse the motor. At this point in time, the signal passing through line 212 may also be employed for reversing the state of the solenoid valves 240, 244, 270 and 272, in which case slide valves 60' and 62' reverse their functions, slide valve 62' providing capacity control and slide valve 60' performing the function of matching the closed thread pressure at pressure sensing port 236 with the pressure at compressor port 22', port 22' acting as the discharge port for the compressor and feeding refrigerant through line 44 to unit 14 acting as a condenser. The thermostat 210 mounted within enclosure 24 feeds a control signal by way of line 266 to the controller 254, thereby adjusting, through motor 260, the position of the slide valve 62' for bypassing refrigerant gas back to the suction side of the machine which enters the port 28' acting as the suction port of the compressor 10' through line 46 connecting coil 12 to the compressor, that coil performing an evaporator function and absorbing heat from the ambient external of enclosure 24. With the exception that the third slide valve 64' must be shifted oppositely due to the change in direction of rotation of the helical screws, the main portion of the heat pump system operates essentially as it did prior to reversal of motor 204, the coil 16 continuing to remove heat passing through wall 30 into the computer room 26 from the enclosure 24, while coil 18 functions to subcool liquid refrigerant passing from coil 14 acting as a condenser within the enclosure 24 to coil 12 acting as an evaporator coil in the ambient.

While the invention has been particularly shown and described with reference to preferred embodiments thereof, it will be understood by those skilled in the art that the foregoing and other changes in form and details may be made therein without departing from the spirit and scope of the invention. For instance, the helical screw rotary compressor may be replaced by a different form of rotary compressor and the multiple slide valves could be carried on the ends of the compressor and pivot about the compressor axis.

Further, while slide valve 66 in FIG. 1 is illustrated as having both an injection port 134 and an ejection port 136 and while the specification has noted previously that the injection port 134 may be eliminated and the ejection port employed to provide intermediate pressure refrigerant vapor for a subcooling coil after condensation, under certain circumstances at minimum load, the ejection port may be employed to supply refrigerant vapor to the outdoor coil which is cut off from direct compressor discharge and thus supply at that point the total needs of the outdoor coil acting as a main loop condenser.

What is claimed is:

1. In a heat pump system including: a positive displacement rotary compressor including a casing having axially spaced end walls and axially spaced suction and discharge ports within said casing open to the casing interior, rotor means mounted for rotation within said casing and forming during rotation closed threads sealed from said ports, and said heat pump system further including a first coil mounted within an enclosure to be conditioned for selective heating and cooling of said enclosure, a second coil external of said enclosure and within the ambient and acting either as a heat sink or heat source, and conduit means for fluid series connecting said compressor and said first and second coils in a closed loop with said conduit means carrying a mass of refrigerant working fluid for circulation therein and expansion valve means intermediate of said coils for operating a selected coil as a refrigerant evaporator, motor means for driving said rotor means for causing refrigerant gas to enter said suction port, to compress said gas within said closed threads and to discharge compressed refrigerant gas under high pressure at said discharge port, and a reversing valve for reversing connections between the compressor ports and said first and second coils respectively, the improvement comprising:

a pair of axially extending recesses within the casing in open communication with the rotor means closed threads, a first slide valve axially slidable relative to said casing and sealably covering one recess with the interface of the slide valve being complementary to the casing confronted by the opening of said one recess, a second slide valve axially slidable relative to said casing for sealably covering the opening of the other recess with the interface of the second slide valve being complementary to the casing confronted by the opening of said other recess, said first slide valve being movable between extreme positions, in one of which said suction port is fully open and the other of which said suction port is closed, and said second slide valve being movable between extreme positions, in one of while the discharge port is fully open and the other in which the discharge port is closed.

means for axially shifting said first slide valve for varying the capacity of the compressor to meet heat pump system load variation, said second slide valve carrying a port opening to the closed threads for sensing the compressed gas pressure within a closed thread immediately adjacent said discharge port, and means for comparing the closed thread pressure just before opening to said discharge port with said compressor discharge pressure at the compressor discharge port and for shifting said second slide valve axially to equalize these pressures and to prevent undercompression or overcompression of the compressor working fluid within the closed thread prior to discharge.

2. The heat pump system as claimed in claim 1, further comprising a third axially extending recess provided within the casing in open communication with the closed threads, a third slide valve axially slidable relative to said casing and sealably covering said third recess, a third coil functioning as a cooling unit, means for fluid connecting said third coil to said closed loop between said first and second coils for receiving liquid refrigerant under high pressure regardless of the direction of flow of refrigerant through said first and second coils, a thermal expansion valve upstream of said third coil for effecting gaseous refrigerant expansion within said third coil, an injection port carried by said third slide valve and opening to a compressor closed thread at a pressure intermediate of compressor suction and discharge pressures, and conduit means for fluid connecting said third slide valve injection port to the discharge side of said third coil, and means responsive to a heat pump system operating parameter for varying the position of said third slide valve.

3. The heat pump system as claimed in claim 2, further comprising check valve means within said conduit means fluid connecting the discharge side of said third coil to said third slide valve injection port and a shunt line fluid connecting the discharge side of said third coil to the closed loop conduit means fluid connecting said second coil to said compressor, and check valve means within said shunt line permitting flow from said third coil towards said compressor and said second coil but preventing reverse flow therefrom.

4. The heat pump system as claimed in claim 2, further comprising a fourth axially extending recess provided within the casing, a fourth slide valve axially slidable relative to said casing and sealably covering said fourth recess, a subcooling coil in heat exchange relation with the conduit, means fluid coupling said first and second coils and intermediate of respective expansion means for said first and said second coils, longitudinally spaced low pressure injection and high pressure ejection ports within said fourth slide valve, conduit means defining a closed secondary refrigeration loop including said fourth slide valve ejection and injection ports and said subcooling coil, and a superheat coil series connected between said ejection port and said subcooling coil within said secondary closed refrigeration loop and in heat exchange relation with the line leading from said reversing valve to said compressor suction port, and thermal expansion means upstream of said subcooling coil and within said secondary loop for expanding liquid refrigerant within said subcooling coil to subcool liquid refrigerant flowing between said first and second coils in said primary refrigeration loop, such that relatively high pressure refrigerant vapor ejected from said fourth slide valve ejection port is condensed within said superheat coil and expanded within said subcooling coil for cooling liquid refrigerant flowing within said primary closed loop.

5. The heat pump system as claimed in claim 3, further comprising a fourth axially extending recess provided within the casing and open to said closed threads, a fourth slide valve axially slidable relative to said casing and sealably covering said fourth recess, conduit means fluid coupling said first and second coils and intermediate of respective expansion means for said first and said second coils, longitudinally spaced low pressure injection and high pressure ejection ports within said fourth slide valve, conduit means defining a closed secondary refrigeration loop including said fourth slide valve ejection and injection ports and said subcooling coil, and a superheat coil series connected between said ejection port and said subcooling coil within said secondary closed refrigeration loop and in heat exchange relation with the line leading from said reversing valve to said compressor suction port, and thermal expansion means upstream of said subcooling coil and within said secondary loop for expanding liquid refrigerant within said subcooling coil to subcool liquid refrigerant flowing between said first and second coils in said primary refrigeration loop, such that relatively high pressure refrigerant vapor ejected from said fourth slide valve ejection port is condensed within said superheat coil and expanded within said subcooling coil for cooling liquid refrigerant flowing within said primary closed loop.

6. The heat pump system as claimed in claim 3, further comprising an EPR valve positioned within the conduit means connecting the discharge side of said third coil with said injection port of said third slide valve and downstream of said shunt line to prevent excessive pressure drop within said third coil under conditions in which said second coil is performing a heat rejecting function.

7. The heat pump system as claimed in claim 4, further comprising an EPR valve positioned within the conduit means connecting the discharge side of said third coil with said injection port of said third slide valve and downstream of said shunt line to prevent too low a pressure within said third coil.

8. The heat pump system as claimed in claim 4, further comprising control means responsive to enclosure temperature for controlling said means for axially shifting said first slide valve, means responsive to the temperature of said third coil for controlling said means for axially shifting said third slide valve to vary the position of said third slide valve injection port relative to a closed thread of said compressor, and means responsive to the difference between compressor suction pressure and compressor discharge pressure for controlling the means for axially shifting said fourth slide valve for varying the position of said injection and ejection ports carried thereby; whereby, said heat pump system operates automatically to thereby match compressor operation to energy demands on said heat pump system.

9. The heat pump system as claimed in claim 7, further comprising control means responsive to enclosure temperature for controlling said means for axially shifting said first slide valve, means responsive to the temperature of said third coil for controlling said means for axially shifting said third slide valve to vary the position of said third slide valve injection port relative to a closed thread of said compressor, and means responsive to the difference between compressor suction pressure and compressor discharge pressure for controlling the means for axially shifting said fourth slide valve for varying the position of said injection and ejection ports carried thereby; whereby, said heat pump system operates automatically to thereby match compressor operation to energy demands on said heat pump system.

10. In a refrigeration system including: a positive displacement rotary compressor including a casing having axially spaced end walls and axially spaced suction and discharge ports within said casing open to the casing interior, rotor means mounted for rotation within said casing and forming during rotation closed threads sealed from said ports, and said refrigeration system further including a condenser coil and an evaporator coil and conduit means fluid connecting said compressor, said condenser and said evaporator coil in a closed series loop, with said conduit means carrying a mass of refrigerant working fluid for circulation therein and expansion valve means upstream of said evaporator coil for expanding refrigerant within said evaporator coil and motor means for driving said rotor means for causing refrigerant in vapor form to enter said suction port, to be compressed within said closed thread and to be discharged under relatively high pressure at said discharge port, the improvement comprising:

at least one axially extending recess within the compressor casing in open communication with the rotor threads, a first slide valve axially slidable relative to said casing and sealably covering said recess with the interface of the first slide valve being complementary to the casing confronted by the opening of said recess, means for axially shifting said first slide valve, an ejection port within said slide valve open to the closed thread for providing partially compressed refrigerant vapor, and a second condenser coil, secondary loop conduit means for connecting said ejection port and said second condenser coil and forming a secondary closed refrigeration loop in parallel with said closed series loop, whereby said ejection port supplies intermediate pressure refrigerant which condenses at a lower condenser pressure than that of said first condenser, with said second condenser supplying a separate load from that of said first condenser, and;

means responsive to the load on the second condenser for controlling the means for axially shifting said first slide valve to vary the pressure of the refrigerant vapor at the point of removal from said compressor by way of said ejection port.

11. The refrigeration system as claimed in claim 10, further comprising an injection port carried by said first slide valve at an axially displaced position relative to said ejection port closer to the suction port of said rotary compressor than that of said ejection port and opening to a closed thread sealed from that closed thread open to said ejection port and closed loop conduit means fluid coupling said injection and ejection ports to partially form a secondary refrigeration loop therebetween.

12. The refrigeration system as claimed in claim 10, wherein said axially extending recesses within said compressor casing in open communication with the rotor threads comprises two in number, a second slide valve is axially slidable relative to the casing and sealably covering the other of said two recesses with the interface of the second slide valve being complementary to the casing confronted by the opening of said other recess, and said system further includes means for axially shifting said second slide valve, an injection port within said second slide valve open to a closed thread different from that in communication with said ejection port of said first slide valve, a third heat exchange coil within said system in addition to said condenser coil and said evaporator coil in fluid communication with said injection port and supplied with refrigerant from said closed loop and means for controlling the means for axially shifting said second valve to vary the point of refrigerant injection into said compressor from said third coil in response to a third coil operating parameter.

13. In a refrigeration system including:

a positive displacement rotary compressor including a casing having axially spaced end walls and axially spaced suction and discharge ports within said casing open to the casing interior, rotor means mounted for rotation within said casing and forming during rotation closed threads sealed from said ports, and said refrigeration system further includes a first coil mounted within an enclosure to be conditioned and a second coil mounted external of said enclosure and within the ambient, conduit means for fluid series connecting said compressor and said first and second coils in a closed loop with said conduit means carrying a mass of refrigerant working fluid for circulation therein and expansion valves intermediate of said coils for operating one of said two coils as a refrigerant evaporator, motor means for driving said rotor means for causing refrigerant gas to enter said suction port, to compress said gas within said closed threads and to discharge compressed refrigerant gas under high pressure at the discharge port, a first axially extending recess within the casing in open communication with the rotor threads, a first slide valve axially slidable relative to said casing and sealably covering said first recess with the interface of said first slide valve being complementary to the casing confronted by the opening of said first recess, said first slide valve being movable between extreme positions, in one of which said suction port is fully open and the other in which said suction port is closed, means for axially shifting said first slide valve for varying the capacity of the compressor to meet system load variations, the improvement comprising:

a third heat exchange coil coupled to said closed loop conduit means and subject to a load independent of that affecting said first and second coils, a second axially extending recess within the casing in open communication with the rotor threads, a second slide valve axially slidable relative to said casing and sealably covering said second recess with the interface of said second slide valve being complementary to the casing confronted by the opening of said second recess, an injection port carried by said second slide valve, means for fluid connecting said injection port to said third heat exchange coil, and means for axially shifting said second slide valve to place said injection port at a closed thread position dependent upon a parameter of operation of said third heat exchange coil.

14. The refrigeration system as claimed in claim 13, further comprising an ejection port carried by said second slide valve at an axially displaced position relative to said injection port at a point closer to the discharge port of said rotary compressor than that of said injection port and opening to a closed thread sealed from the closed thread open to said injection port to reduce compressor load by limiting the amount of refrigerant fully compressed by said compressor.

15. The refrigeration system as claimed in claim 13, further comprising a third axially extending recess within said casing in open communication with the rotor threads, a third slide valve axially slidable relative to said casing and sealably covering said third recess with the interface of said slide valve being complementary to the casing confronted by the opening of said third recess, an ejection port carried by said third slide valve to reduce compressor load by limiting the amount of refrigerant fully compressed by said compressor and means for axially shifting said third slide valve to place said ejection port at a closed thread position dependent upon a parameter of operation of said refrigeration system.

16. In a refrigeration system including:

a positive displacement rotary compressor including a casing having axially spaced end walls and axially spaced suction and discharge ports within said casing open to the casing interior, rotor means mounted for rotation within said casing and forming during rotation closed threads sealed from said ports, said system further including a first coil mounted within an enclosure to be conditioned and a second coil mounted external of said enclosure and within the ambient, conduit means for fluid series connecting said compressor and said first and second coils in a closed loop with said conduit means carrying a mass of refrigerant working fluid for circulation therein and expansion valves intermediate of said coils for operating a selected coil as a refrigerant evaporator, motor means for driving said rotor means for causing refrigerant gas to enter said suction port, to be compressed within said closed threads and to be discharged under high pressure at said discharge port, the improvement comprising:

a pair of axially extending recesses within the casing in open communication with the rotor threads, a first slide valve axially slidable relative to said casing and sealably covering one recess with the interface of the slide valve being complementary to the casing confronted by the opening of said one recess, a second slide valve axially slidable relative to said casing for sealably covering the opening of the other recess with the interface of the second slide valve being complementary to the casing confronted by the opening of said other recess, said second slide valve carrying a port opening to the closed threads for sensing the compressed gas pressure within a closed thread immediately adjacent said discharge port, means for comparing the closed thread pressure just before opening to said discharge port with said compressor discharge pressure at the compressor discharge port and for shifting said first slide valve axially to equalize these pressures and to prevent undercompression or overcompression of the compressor working fluid within the closed thread prior to discharge, an injection port within said first slide valve open to the closed threads, means for fluid connecting said injection port to an element of the refrigeration system carrying refrigerant in vapor form at a pressure lower than that of the compressor discharge port, and means responsive to an operating parameter of said closed loop refrigeration system for controlling the means for axially shifting said first slide valve to vary the point of injection of refrigerant vapor into said compressor.

17. The refrigeration system as claimed in claim 16, further comprising an ejection port carried by said first slide valve at an axially displaced position relative to said injection port at a point further from said suction port than that of said injection port and opening to a closed thread sealed from that closed thread open to said injection port for providing partially compressed refrigerant vapor to said system.

18. The refrigeration system as claimed in claim 16, further comprising a third axially extending recess within said casing in open communication with the rotor threads, a third slide valve axially slidable relative to said casing and sealably covering said third recess with the interface of said slide valve being complementary to the casing confronted by the opening of said third recess, an ejection port carried by said third slide valve and opening to a closed thread sealed from that closed thread open to said injection port of said first slide valve for providing partially compressed refrigeration vapor to said system, and means responsive to an operating parameter of said closed loop refrigeration system for axially shifting said third slide valve to vary the point of refrigerant vapor ejection from said compressor by way of said ejection port.

19. In a refrigeration system including:

a positive displacement rotary compressor including a casing having axially spaced end walls and axially spaced suction and discharge ports within said casing open to the casing interior, rotor means mounted for rotation within said casing and forming during rotation closed threads sealed from said ports, and said refrigeration system further includes a first coil mounted within an enclosure to be conditioned and a second coil mounted external of said enclosure and within the ambient, conduit means for fluid series connecting said compressor and said first and second coils in a closed loop with said conduit means carrying a mass of refrigerant working fluid for circulation therein and expansion valves intermediate of said coils for operating one of said two coils as a refrigerant evaporator, motor means for driving said rotor means for causing refrigerant gas to enter said suction port, to compress said gas within said closed threads and to discharge compressed refrigerant gas under high pressure at the discharge port, a first axially extending recess within the casing in open communication with the rotor threads, a first slide valve axially slidable relative to said casing and sealably covering said first recess with the interface of said first slide valve being complementary to the casing confronted by the opening of said first recess, said first slide valve being movable between extreme positions, in one of which said suction port is fully open and the other in which said suction port is closed, means for axially shifting said first slide valve for varying the capacity of the compressor to meet system load variations, the improvement comprising:

a third heat exchange coil coupled to said closed loop conduit means and subject to a load independent of that affecting said first and second coils, a second axially extending recess within said casing in open communication with the rotor thread, a second slide valve axially slidable relative to said casing and sealably covering said second recess with the interface of the second slide valve being complementary to the casing confronted by the opening of said second recess, an ejection port carried by said second slide valve and opening to the compressor closed threads intermediate of said compressor suction and discharge ports, means for fluid connecting said ejection port to said third heat exchange coil for supplying compressed refrigerant vapor thereto independently of refrigerant flow to said first and second coils, and means responsive to heat exchange load on said system coil for shifting said second slide valve to vary the supply of refrigerant supplied by said ejection port to said third heat exchange coil.

20. The refrigeration system as claimed in claim 19, further comprising an injection port carried by said compressor and opening to a closed thread at a pressure lower than that at said ejection port, and means for fluid connecting said injection port to said third heat exchange coil on the side of said third heat exchange coil remote from the fluid connection of said third heat exchange coil to said ejection port.

21. In a heat pump system including: a positive displacement rotary compressor including a casing having axially spaced ports in fluid communication with said casing interior, rotor means mounted for rotation within said casing and forming during rotation closed threads sealed from said ports, and said heat pump system further including a first coil mounted within an enclosure to be conditioned for selective heating and cooling of said enclosure, a second coil external of said enclosure and within the ambient and acting either as a heat sink or heat source, and conduit means for fluid, series connecting said compressor and said first and second coils in a closed loop with said conduit means carrying a mass of refrigerant working fluid for circulation therein and expansion valve means intermediate of said coils for operating a selected coil as a refrigerant evaporator, bidirectional motor means for driving said rotor means in either of two directions for causing refrigerant gas to enter selectively one of said ports under suction, to compress said gas within said closed threads and to discharge compressed refrigerant gas under high pressure from said compressor at said other port and vice versa, the improvement comprising:

a pair of axially extending recesses within the casing in open communication with the rotor threads, a first slide valve sealably axially slidable on said casing relative to one recess with the interface of the slide valve being complementary to the casing confronted by the opening of said one recess, a second slide valve sealably axially slidable on said casing and being complementary to the casing confronted by the opening of the other recess, said slide valves being movable between extreme positions in one of which a given port is fully open and the other in which a given port is closed, each slide valve carrying means for sensing the compressed gas pressure within a closed thread immediately adjacent the port within said casing formed by its recess, motor means for axially shifting said slide valves, means operatively coupled to said sensing means for selectively comparing a closed thread pressure just before opening to the port acting as the discharge port for the compressor with said compressor discharge pressure at that port depending upon the direction of rotation of said rotor means, means for operating said motor means for shifting the other slide valve associated with the port acting as the suction port for said compressor under such conditions for varying the capacity of the compressor to meet heat pump system load variations, and means for operating said motor means for shifting said slide valve associated with the discharge port in response to said comparing means to equalize the closed thread pressure immediately adjacent the discharge port with the compressor discharge pressure at said compressor discharge port to prevent undercompression and overcompression of the compressor working fluid within the closed thread prior to discharge.

22. The heat pump system as claimed in claim 21, further comprising a third axially extending recess provided within said casing in open communication with said closed threads, a third slide valve axially slidable on said casing and sealing said third recess and being complementary to said casing, and wherein said heat pump system includes a third coil functioning as a cooling unit, means for fluid connecting said third coil to said closed loop between said first and second coils for receiving liquid refrigerant under high pressure regardless of the direction of flow of refrigerant through said first and second coils, a thermal expansion valve upstream of said third coil for effecting gaseous refrigerant expansion within said third coil, an injection port carried by said third slide valve and opening to a compressor closed thread at a pressure intermediate of compressor suction and discharge pressures, conduit means for fluid connnecting said third slide valve injection port to the discharge side of said third coil, and means responsive to a heat pump system operating parameter for varying the position of said third slide valve.

23. The heat pump system as claimed in claim 22, further comprising an EPR valve positioned within said conduit means connecting the discharge side of the third coil with said injection port of said third slide valve and downstream of said third coil to prevent too low a pressure within said third coil.

24. The heat pump system as claimed in claim 23, further comprising a subcooling coil in heat transfer position with respect to said conduit means interconnecting said first and second coils and intermediate of respective expansion means for said first and second coils, means for bleeding a portion of high pressure liquid refrigerant from said conduit means interconnecting said first and second coils and for supplying liquid refrigerant to said subcooling coil, expansion means upstream of said subcooling coil for expanding said liquid refrigerant within said subcooling coil for subcooling liquid refrigerant within said closed loop, and return conduit means for connecting the discharge side of said subcooling coil to said conduit means fluid connecting the discharge side of said third coil to said third slide valve injection port.

25. The heat pump system as claimed in claim 10, wherein said return conduit means is connected to said conduit means fluid connecting said third slide valve injection port to the discharge side of said third coil downstream of said EPR valve.

* * * * *